US010961015B2

(12) United States Patent
Bethune-Bates

(10) Patent No.: US 10,961,015 B2
(45) Date of Patent: Mar. 30, 2021

(54) LOCKING FOLDING CARTON

(71) Applicant: Diamond Packaging, Rochester, NY (US)

(72) Inventor: Lesley Bethune-Bates, Rochester, NY (US)

(73) Assignee: Diamond Packaging, Rochester, NY (US)

( * ) Notice: Subject to any disclaimer, the term of this patent is extended or adjusted under 35 U.S.C. 154(b) by 0 days.

(21) Appl. No.: 16/420,426

(22) Filed: May 23, 2019

(65) Prior Publication Data

US 2019/0359376 A1 Nov. 28, 2019

Related U.S. Application Data

(60) Provisional application No. 62/675,466, filed on May 23, 2018.

(51) Int. Cl.
*B65D 5/66* (2006.01)

(52) U.S. Cl.
CPC ..... *B65D 5/6691* (2013.01); *B65D 5/6688* (2013.01)

(58) Field of Classification Search
CPC B65D 5/6691; B65D 5/6688; B65D 85/1045; B65D 85/1054; B65D 5/662; B65D 85/10; B65D 5/422; B65D 5/543; B65D 50/00; A24F 15/00
USPC ..... 229/160.1, 146, 125.08; 206/268; 220/810
See application file for complete search history.

(56) References Cited

U.S. PATENT DOCUMENTS 3,977,520 A * 8/1976 Grimm ..... B65D 85/1054 206/270
2008/0230410 A1* 9/2008 Steven Jones ..... B65D 5/6691 206/268
2009/0038966 A1 2/2009 Ghini et al.
2009/0205982 A1 8/2009 Hein et al.
2011/0062175 A1 3/2011 Nakamura et al.
2012/0261285 A1 10/2012 Holloway et al.
2013/0140201 A1 6/2013 Ghini et al.
(Continued)

FOREIGN PATENT DOCUMENTS

WO 2016012907 1/2016

OTHER PUBLICATIONS

Internal Search Report and Written Opinion for International Application No. PCT/US2019/033674 dated Aug. 12, 2019, 8 pages.

*Primary Examiner* — Christopher R Demeree
(74) *Attorney, Agent, or Firm* — Bond, Schoeneck & King, PLLC; Joseph Noto

(57) ABSTRACT

A locking folding carton includes an insert having a product cavity and at one end a pull tab; and an outer carton having a hinged lid having an angled opening at one end and a finger notch at the other end, wherein the combined insert and carton allows for a voided space inside of the carton adjacent the pull tab end while the insert is within the carton in a closed position, and wherein the hinge and the geometry of the angled lid opening prevents the lid from being opened while the insert is within the carton in a closed position and wherein the insert is moveable within the outer carton to an open position with the voided space inside of the carton adjacent the angled opening end and wherein the hinge and the geometry of the angled lid opening allows the lid to be opened while the insert is within the carton in the open position.

6 Claims, 9 Drawing Sheets

(56) References Cited

U.S. PATENT DOCUMENTS

| | | | | |
|---|---|---|---|---|
| 2013/0248392 | A1 | 9/2013 | Roila et al. | |
| 2015/0014404 | A1 | 1/2015 | Iwata et al. | |
| 2016/0100630 | A1 | 4/2016 | Clark et al. | |
| 2016/0227835 | A1 | 8/2016 | Swede et al. | |
| 2016/0251107 | A1* | 9/2016 | Everett | B65D 59/04 206/1.5 |
| 2017/0113865 | A1 | 4/2017 | Swede et al. | |
| 2018/0029784 | A1 | 2/2018 | Paradiso et al. | |
| 2019/0375537 | A1* | 12/2019 | Nakovski | B65B 5/04 |

* cited by examiner 5
2
FRONT

TURN
6
2
BACK 6
2
BACK 3
4
6
2
BACK

3
TURN
7
PRODUCT
CAVITY
1
2
FRONT

LOCKING FOLDING CARTON

CROSS REFERENCE

This application claims the benefit of the filing date of U.S. Provisional Patent Application Ser. No. 62/675,466, filed May 23, 2018, which is hereby incorporated by reference in its entirety.

FIELD

The present invention relates generally to a locking package having the telescoping components of an insert and an outer carton, wherein movement of unoccupied space within the outer carton enables locking and un-locking of the carton.

BACKGROUND

In the field of locking packaging for a wide range of consumer goods, it is desired to provide consumers with secure packaging, particularly healthcare and medication packaging, having features to restrict or prevent access to the contents by a certain group of individuals while at the same time providing access with some degree of ease by another group of individuals.

SUMMARY

In accordance with one aspect of the present disclosure, there is provided a locking folding carton including an insert configured to fit within an outer carton and including a product cavity having at one end a pull tab; and the outer carton including a hinged lid having an angled opening at one end and a finger notch at the other end, wherein the combined insert and outer carton comprises a voided space inside of the carton adjacent the pull tab end while the insert is within the carton in a closed position, and wherein the hinge and the geometry of the angled lid opening prevents the lid from being opened while the insert is within the carton in the closed position, and wherein the insert is moveable within the outer carton to an open position including the voided space inside of the carton adjacent the angled opening end and wherein the hinge and the geometry of the angled lid opening allows the lid to be opened while the insert is within the carton in the open position.

In accordance with another aspect of the present disclosure, there is provided a method for un-locking a package including removing a perforated thumb-notch at the bottom back of an outer carton at the back of the package; accessing a pull tab that extends from the bottom of a product cavity insert into a voided space within the bottom of the outer carton; grasping the pull tab and sliding the product cavity into the voided space inside the outer carton to an open position; and opening a hinged lid by breaking perforations on the front top of the outer carton so the lid will freely fold back along the hinge allowing access to the product cavity.

In accordance with another aspect of the present disclosure, there is provided a method for re-locking the package by closing the lid along the hinge; and pushing the pull tab that extends from the bottom of the product cavity into the outer carton returning the insert to a locked position and preventing access to the product cavity by not allowing the hinged lid to open due to the relative positioning of the hinge, the geometry of the angled perforated lid opening, and the position of unoccupied space.

These and other aspects of the present disclosure will become apparent upon a review of the following detailed description and the claims appended thereto.

DETAILED DESCRIPTION

The package is composed of a combination of two components; an insert 1 and an outer carton 2 that function together. The illustrations and described features below depict the insert 1 and outer carton 2 that work in a variety of paperboard and plastic materials.

Figure 1:
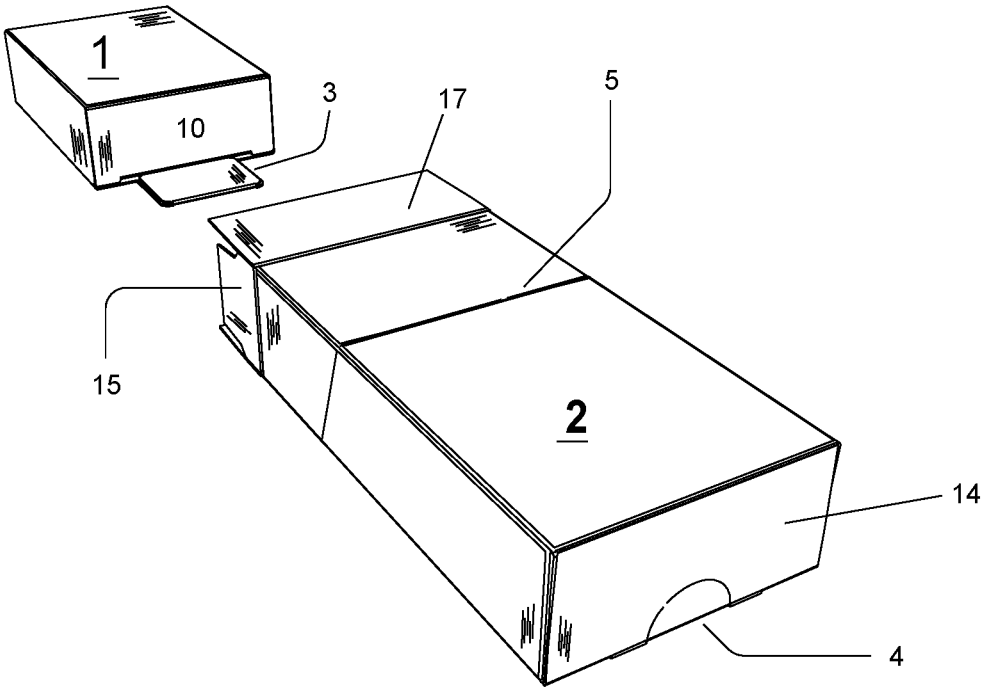
FIG. 1 is a perspective view of a locking folding carton in a telescoping assembled configuration in accordance with an embodiment of the present invention.

In reference to FIG. 1, the locking package in an embodiment is composed of two telescoping paperboard components, e.g., an insert 1 and an outer carton 2. FIG. 1 shows the proper position and alignment to assemble the insert 1 into the outer carton 2.

Figure 2:
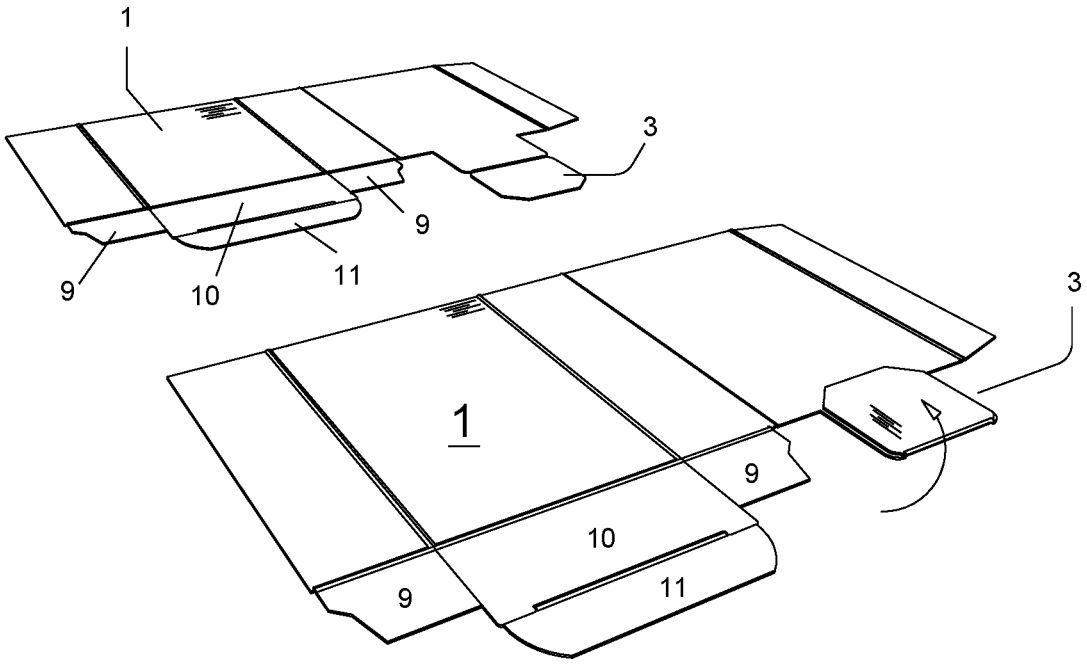
FIG. 2 is a perspective plan view of a carton insert pull tab fold over sequence in accordance with an embodiment of the present invention.
Figure 8:
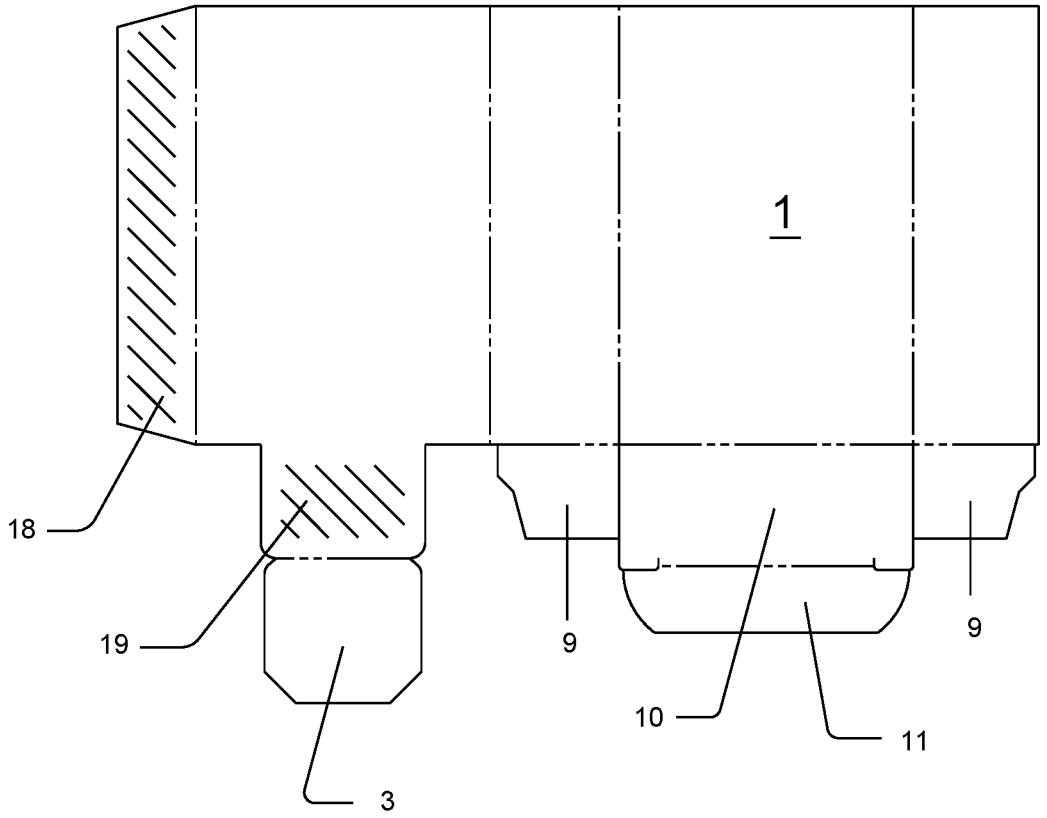
FIG. 8 illustrates a plan view of the insert.

As referenced in FIGS. 2 & 8, the various panels are folded about their respective scores and glued in the area referenced by 18, thus the insert 1 forms a product cavity 7 that includes a pull tab 3, as shown in FIG. 5. The pull tab 3 may be reinforced by adding a second folded layer glued to the area 19 as referenced in FIG. 2 & FIG. 8. This decision is based on material strength and product weight.

Figure 3:
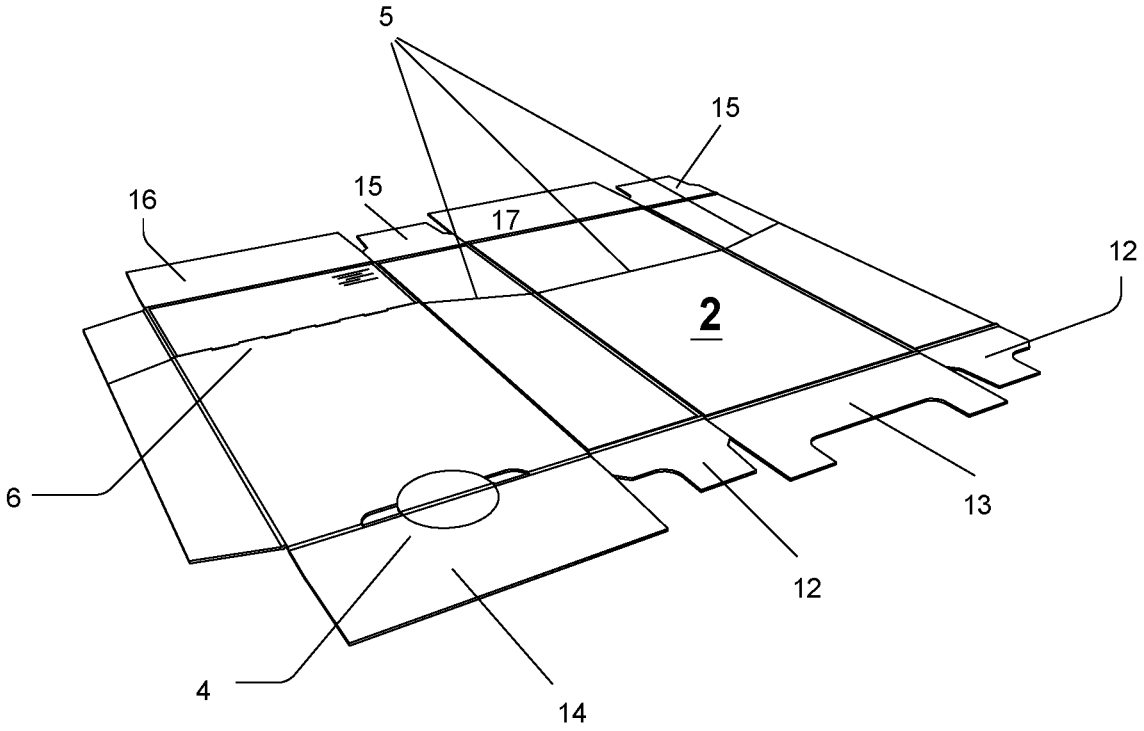
FIG. 3 is a perspective plan view of the carton outer sleeve in accordance with an embodiment of the present invention.
Figure 9:
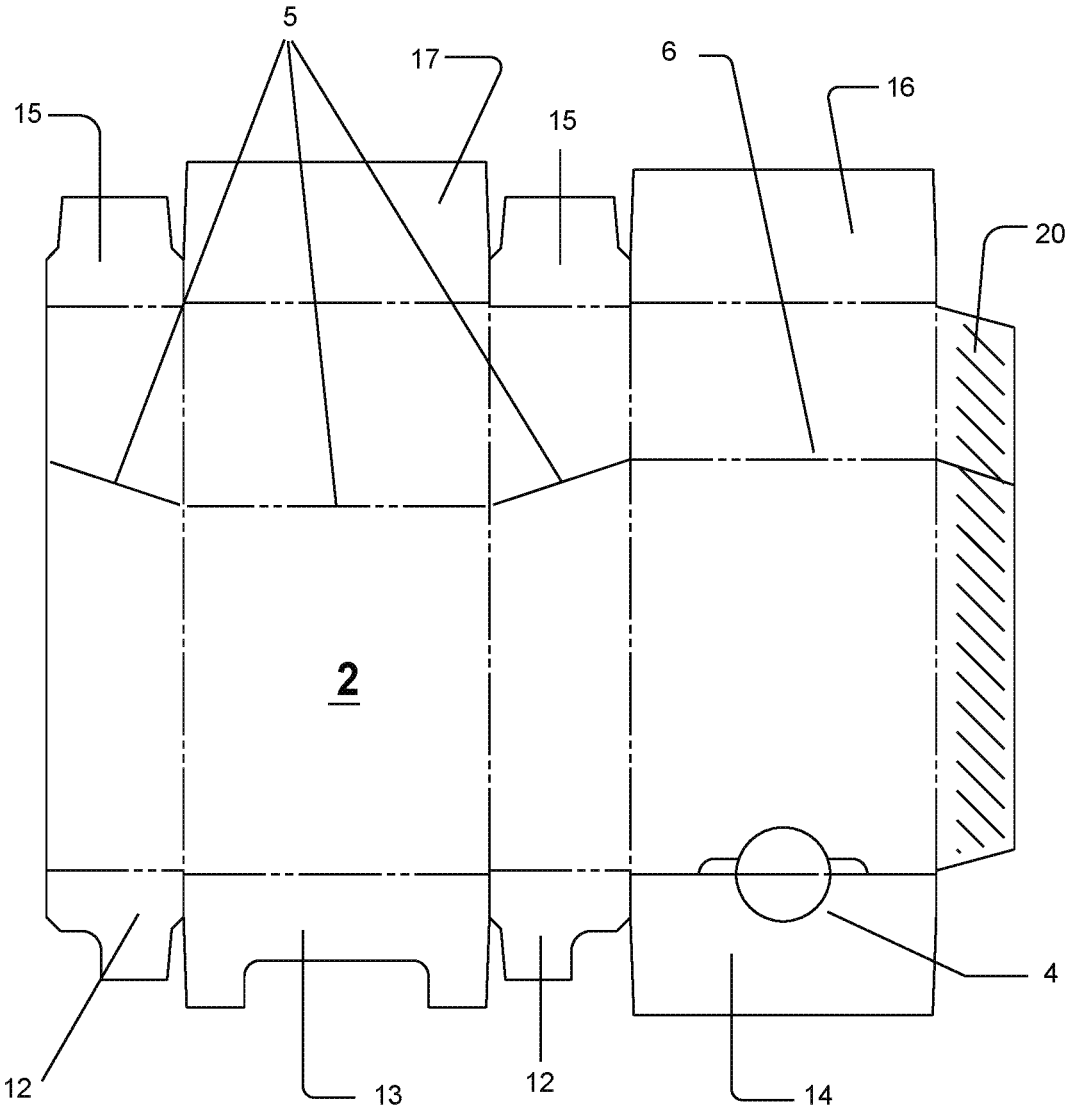
FIG. 9 illustrates a plan view of the outer carton.

As referenced in FIG. 3, a plan view of the outer carton 2, the supplemental perforated cuts 5 and a cut/score 6 perform as the angled opening and the hinge that connects the lid to the base and allow the top to open and close. As referenced in FIGS. 3 & 9 the various panels are folded about their respective scores and glued in the area noted in FIG. 9 area 20.

Also reference in FIG. 3 the perforated thumb notch 4 of the outer carton 2 that corresponds in placement with the pull tab 3 of the insert 1 which covers and denies access to said pull tab 3 during shipping & distribution. The thumb notch 4 will eventually be removed to allow access to the pull tab 3 which is instrumental to unlocking and opening the package, allowing access to the product cavity 7.

Figure 4:
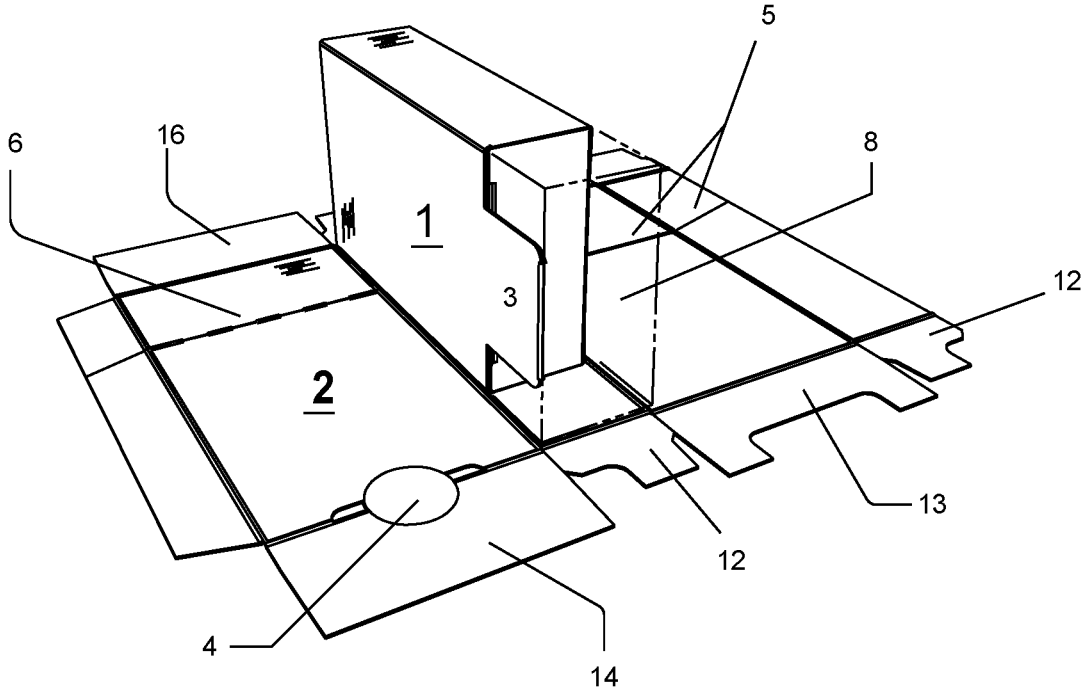
FIG. 4 is a perspective view of the assembled insert and the outer carton.

FIG. 4 is a perspective plan view of the outer carton 2 and the assembled insert 1, product cavity 7. This view shows the relationship between the insert 1, product cavity 7 and the outer carton 2; including the proper placement and alignment of the pull tab 3 with the perforated thumb notch 4 and the position of the unoccupied space 8 required for the insert 1, product cavity 7 to move from locked to unlocked position.

As can be seen in FIGS. 5A, 5B, and 5C & FIGS. 6A, 6B, and 6C when assembled, the embodiment of the combined insert 1 and carton 2 creates a product cavity 7 and an unoccupied space 8 inside of the carton 2 that allows the product cavity 7 to slide from an upper locked to a lower un-locked position depending on the open or closed position of the pull tab 3.

As can be seen in FIGS. 5A, 5B and 5C & FIGS. 6A, 6B and 6C, due to the relative positioning of the hinge 6, the geometry of the angled perforated lid opening 5, and the position of the unoccupied space 8, the lid cannot be opened while the pull tab 3 is inside the carton 2 and the product cavity 7 is in the upper closed position. The product cavity 7 and unoccupied space 8 in the lower closed position prevents the lid from swinging open.

As can be seen in FIGS. 5A, 5B and 5C & FIGS. 6A, 6B and 6C, due to the relative positioning of the hinge 6, the geometry of the angled perforated lid opening 5, and the position of unoccupied space 8, the lid can be opened while the pull tab 3 is outside the carton 2 and the insert 1 is in the down open position. Thus, moving the unoccupied space 8 to the top of the outer carton 2 allowing the lid to swing open and giving access to the product cavity 7.

Instructions for Assembly: To form the insert 1 the various panels are folded open about their respective fold lines, as shown in FIG. 8. Close the bottom of the insert 1 by folding in the dust flaps 9 and folding the tuck panel 10 and inserting the tuck flap 11. The reinforced pull tab 3 will extend out from the bottom back. The insert 1 may now be referred to as the product cavity 7.

To form the outer carton 2 the various panels are folded open about their respective fold lines, as shown in FIG. 9. Note the bottom of the outer carton 2 is the end with the perforated thumb notch 4. Close the bottom of the outer carton 2 by folding in the bottom dust flaps 12. Seal by folding in the inner seal end flap 13 first then fold and adhere the outer seal end flap 14 to the inner flap 13.

Place item(s) to be stored into the open end of the insert 1. Insert 1 may now be referred to as the product cavity 7.

As seen in FIG. 1 align the insert 1, and outer carton 2, so the reinforced pull tab 3 on the insert 1, is on the same side as the perforated finger notch 4 on the back of the carton. Slide the insert 1 into the outer carton 2.

Close the top of the outer carton 2 by folding in the top dust flaps 15. Seal by folding in the inner seal end flap 16 first then fold and adhere the outer seal end flap 17 to the inner flap 16.

Figures 7A, 7B, 7C, 7D, 7E:
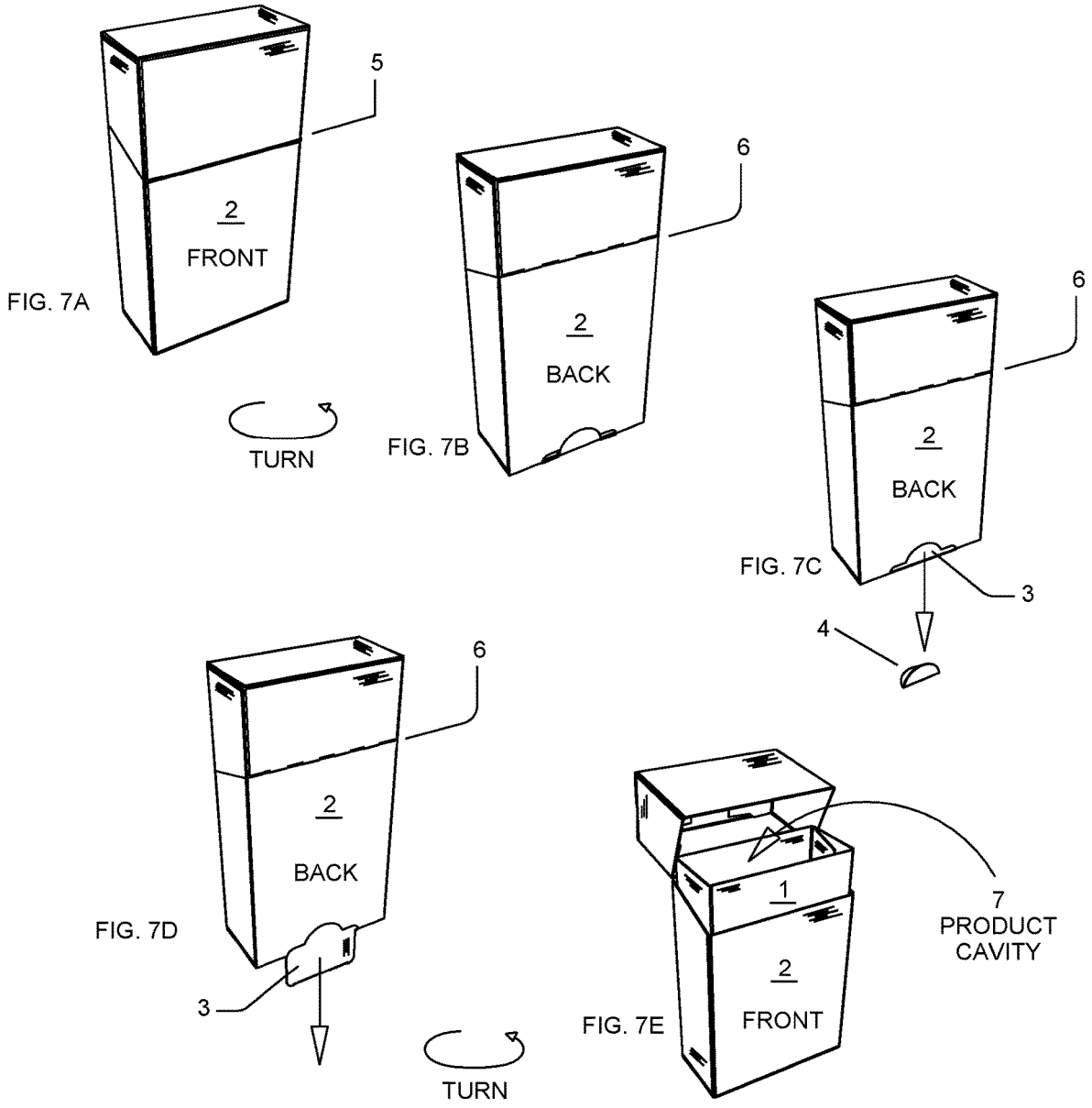
FIGS. 7A-7E show multiple perspective views of the locking folding carton including the motions and steps required to unlock and open the hinged top giving access to the product cavity.

Instructions to un-lock and re-lock the package: To unlock the package, as shown in FIGS. 7A, 7B and 7C and looking at the back of the package, remove the perforated thumb-notch 4 on the bottom back of the outer carton 2. This allows access to the reinforced pull tab 3 that extends from the bottom of the product cavity 7. FIG. 7D shows that the reinforced pull tab 3 is on the back, opposite the hinged lid that opens on the front which is shown in FIG. 7E.

Figures 5A, 5B, 5C:
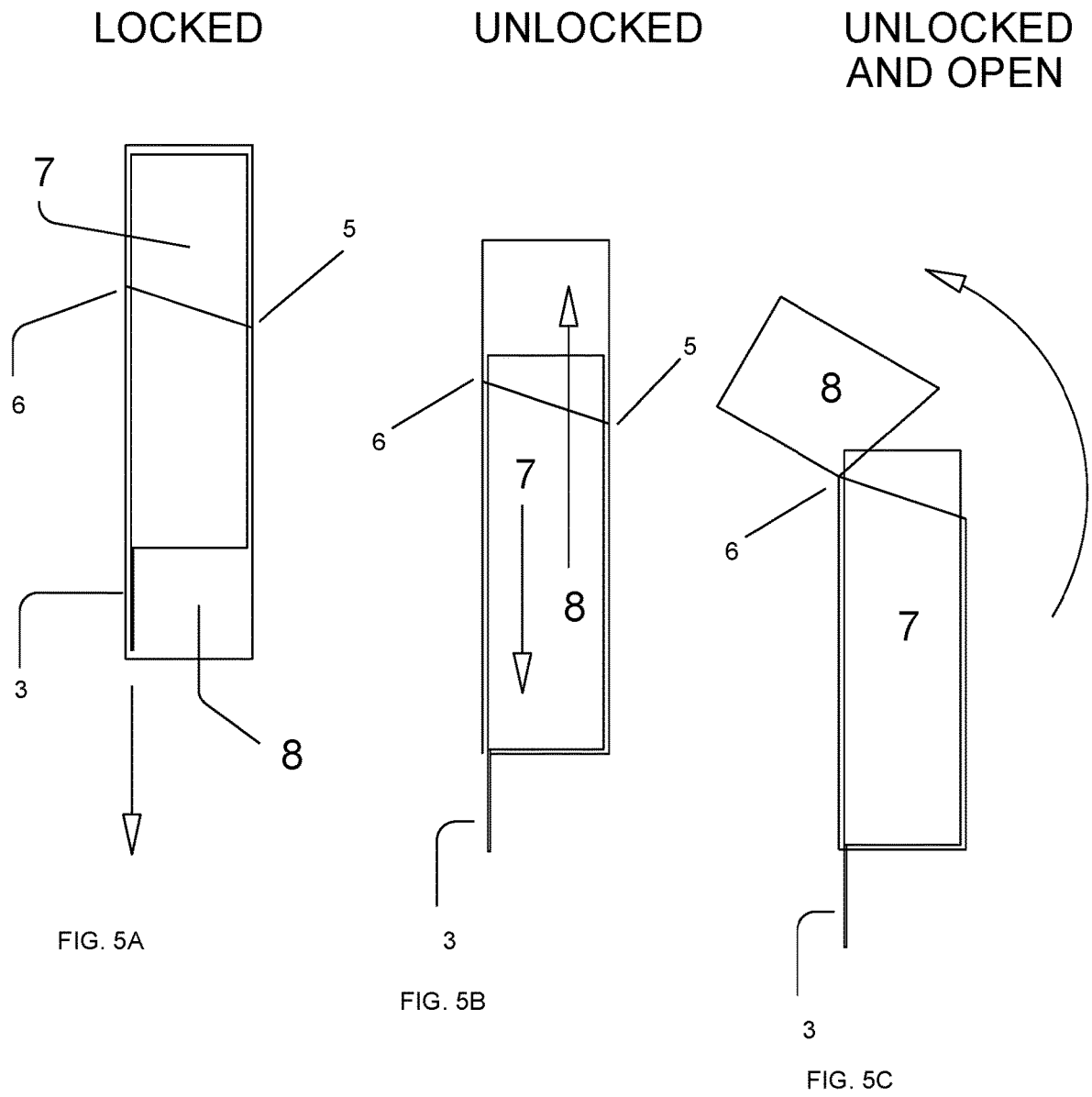
FIG. 5A shows a side cross-section view of the assembled insert inside the assembled outer carton.
FIG. 5B shows how to unlock.
FIG. 5C shows how to open the hinged top of the unlocked package.

As seen in FIG. 5A grasp the reinforced pull tab 3 and pull out/back and down. As seen in FIG. 5B the product cavity 7 will move/slide down into the voided space 8 inside the outer carton 2.

After the reinforced tab 3 is pulled and the product cavity 7 is moved into the open position, grasp the top of the outer carton 2. As seen in FIG. 5C & FIG. 7E the perforations 5 should be broken so the top/lid will freely fold back along the hinge 6. This allows access to the product cavity 7 created by the insert 1.

Figures 6A, 6B, 6C:
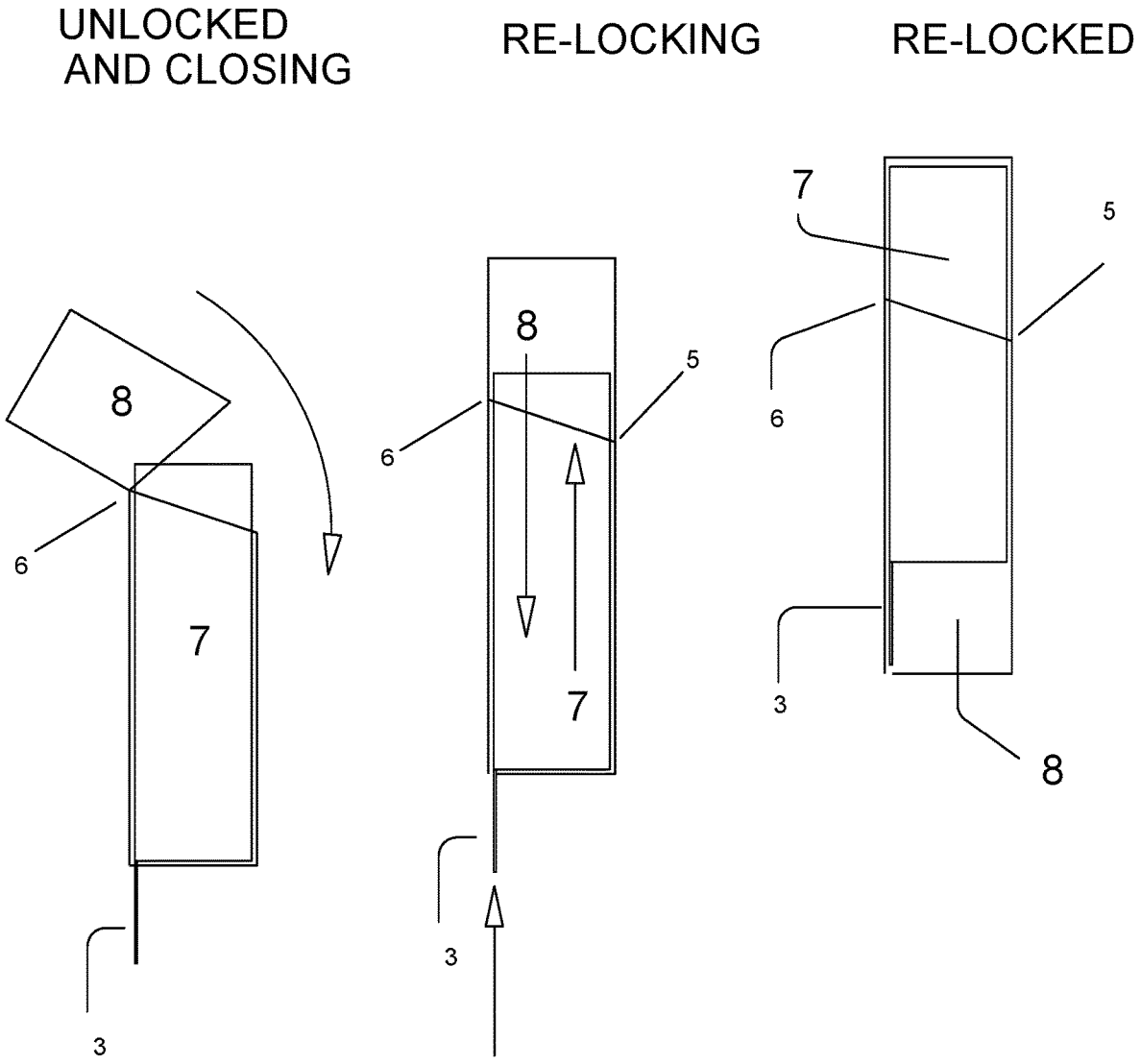
FIG. 6A shows a side cross-section view of how to close the hinged top of the opened unlocked package.
FIG. 6B shows re-locking of the closed package.
FIG. 6C shows a re-locked package.

To re-lock the package, as seen in FIG. 6A close the top/lid along the hinge 6. As shown in FIG. 6B push the reinforced pull tab 3 that extends from the bottom of the product cavity 7 into the outer carton 2. Due to the relative positioning of the hinge 6, the geometry of the angled perforated lid opening 5, and the position of unoccupied space 8 this will return the insert 1 to the locked position, and will prevent access to the product cavity 7 by not allowing the hinged lid to open.

In accordance with the present invention, the hinged lid will not close while the reinforced tab 3 is inside the outer carton 2 or the product cavity 7 is in the upper open position. The reinforced pull tab 3 must be pulled out, and the product cavity in the down/open position for the hinged lid to swing freely open or closed. Likewise the reinforced tab 3 must be inside the outer carton 2 and the product cavity in the upper/closed position for the package to remain locked.

Although various embodiments have been depicted and described in detail herein, it will be apparent to those skilled in the relevant art that various modifications, additions, substitutions, and the like can be made without departing from the spirit of the disclosure and these are therefore considered to be within the scope of the disclosure as defined in the claims which follow.

What is claimed:

1. A locking folding carton comprising:

an insert configured to fit within an outer carton, the insert comprising a product cavity and having a pull tab at a first insert end; and the outer carton comprising a hinged lid having an angled opening at a first outer carton end and a finger notch at a second outer carton end, wherein the combined insert and outer carton comprises a voided space inside of the carton adjacent the pull tab and second outer carton end with the insert pull tab inside the carton while the insert is within the carton in a locked position, and wherein the hinge and the geometry of the angled lid opening prevents the lid from being opened while the insert is within the carton in the locked position, and wherein the insert is moveable within the outer carton wherein the insert pull tab extends outside the carton to an unlocked position comprising the voided space inside of the carton adjacent the angled opening outer carton first end and wherein the hinge and the geometry of the angled lid opening allows the lid to be opened while the insert is within the carton in the unlocked position.

2. A locking folding carton comprising:

an insert configured to be moveable and fit within an outer carton, the insert comprising a product cavity and having a graspable member and adjacent void space at a first insert end; and the outer carton comprising a hinged lid having an angled opening at a first outer carton end and a notch at a second outer carton end, wherein a locked position comprises the insert disposed within the outer carton with the graspable member and adjacent void space disposed at the second outer carton notch end and the hinged lid closed, and wherein an unlocked position comprises the insert disposed within the outer carton occupying the void space with the graspable member extending beyond the second outer carton notched end.

3. The carton of claim 2, wherein the graspable end comprises a pull tab.

4. The carton of claim 2, further comprising an open position wherein the hinged lid is open in the unlocked position.

5. The carton of claim 2, wherein the hinged lid and the geometry of the angled opening prevents the lid from being opened in the locked position.

6. The carton of claim 2, wherein the product cavity is exposed in the open position.

* * * * *